US005382014A

United States Patent [19]

Fukube

[11] Patent Number: 5,382,014

[45] Date of Patent: Jan. 17, 1995

[54] SHEET FEED DEVICE FOR IMAGE FORMING EQUIPMENT USING A DIELECTRIC, RECIPROCATING PLATE

[75] Inventor: Noriaki Fukube, Soka, Japan

[73] Assignee: Ricoh Company, Ltd., Tokyo, Japan

[21] Appl. No.: 94,424

[22] Filed: Jul. 16, 1993

[30] Foreign Application Priority Data

Jul. 23, 1992 [JP] Japan ..... 4-197112

[51] Int. Cl.[6] ..... B65H 3/16

[52] U.S. Cl. ..... 271/18.1; 271/18.2

[58] Field of Search ..... 271/10, 18.1, 18.2, 271/42, 128, 129, 139, 140

[56] References Cited

U.S. PATENT DOCUMENTS

| | | | |
|---|---|---|---|
| 4,864,461 | 9/1989 | Kasahara | 271/18.1 X |
| 4,928,947 | 5/1990 | Beery | 271/42 X |
| 5,003,325 | 3/1991 | Bibl | 271/18.1 X |
| 5,176,374 | 1/1993 | Yamada | 271/18.1 X |
| 5,219,154 | 6/1993 | Fukube et al. | 271/18.2 |

FOREIGN PATENT DOCUMENTS

| | | | |
|---|---|---|---|
| 86334 | 5/1986 | Japan | 271/18.1 |
| 75539 | 3/1990 | Japan | 271/18.1 |
| 659494 | 4/1979 | U.S.S.R. | 271/18.2 |
| 1013377 | 4/1983 | U.S.S.R. | 271/18.1 |
| 1601052 | 10/1990 | U.S.S.R. | 271/18.1 |

*Primary Examiner*—Robert P. Olszewski
*Assistant Examiner*—Boris Milef
*Attorney, Agent, or Firm*—Oblon, Spivak, McClelland, Maier & Neustadt

[57] ABSTRACT

A sheet feed device for image forming equipment and capable of feeding sheets one by one from a stack by separating them. The device has a flat plate including a dielectric portion which is capable of making surface-to-surface content with the top of the stack, a unit for moving the plate in a reciprocating motion, a unit for moving the plate into and out of contact with the stack, and a unit for applying a voltage to the plate to cause it to exert an electrostatic adhering force.

9 Claims, 13 Drawing Sheets

SHEET FEED DEVICE FOR IMAGE FORMING EQUIPMENT USING A DIELECTRIC, RECIPROCATING PLATE

BACKGROUND OF THE INVENTION

The present invention relates to a laser beam printer, copier, facsimile transceiver or similar image forming equipment and, more particularly, to a device incorporated in such equipment for sequentially separating and feeding cut sheets one by one from a stack.

A predominant type of sheet feed device for the above application uses a pick-up member in the form of a roller or a belt made of a material having a high coefficient of friction, e.g., rubber. The pick-up member feeds sheets on the basis of friction. Another conventional sheet feed device feeds sheets by sucking them, i.e., under vacuum.

The friction type sheet feed device is simple in construction. However, this type of device cannot exert a great frictional force unless a spring or similar resilient member presses the pick-up member against the top of the stack. i.e., uppermost sheet. Another drawback with such a device is that rubber or similar material having a high coefficient of friction is apt to have the coefficient noticeably changed due to the varying ambient conditions, degrading the stability of operation. In addition, since the pressing contact of the pick-up member with the sheet stack is not delicately adjusted, two or more sheets are often fed out together. To eliminate this occurrence, an extra mechanism for surely separating the uppermost sheet from the others is indispensable.

The suction type sheet feed device is advantageous over the friction type device in respect of stable sheet feed. However, the suction scheme generates great noise in the event of suction of air and increases the overall dimensions of the device.

Japanese Utility Model Laid-Open Publication (Kokai) No. 85543/1985 discloses a sheet feed device capable of separating sheets by electrostatic adhesion. Specifically, this sheet feed device has a flat sheet feed member capable of exerting an electrostatic adhering force, a means for moving the flat member substantially in a linear reciprocating motion, and a means for selectively applying or interrupting a voltage for generating or cancelling the adhering force. With this kind of approach, however, it is difficult to separate one sheet from the others due to the leak of electric field, resulting in the simultaneous feed of two or more sheets. In the light of this, Japanese Patent Laid-Open Publication (Kokai) No. 176472/1985 proposes an improved electrode pattern.

SUMMARY OF THE INVENTION

It is therefore an object of the present invention to provide a sheet feed device for image forming equipment which can separate and feed sheets stably with no regard to aging or varying ambient conditions and which is simple in construction.

In accordance with the present invention, a sheet feed device for image forming equipment and capable of feeding sheets one by one from a stack by separating them comprises a plate having a dielectric portion capable of making surface-to-surface contact with the top of the stack, a reciprocating mechanism for causing the plate to move in a reciprocating motion, a moving mechanism for selectively moving the plate into or out of contact with the top of the stack, and a voltage applying circuit for applying a voltage to the plate to cause it to exert an electrostatic adhering force.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
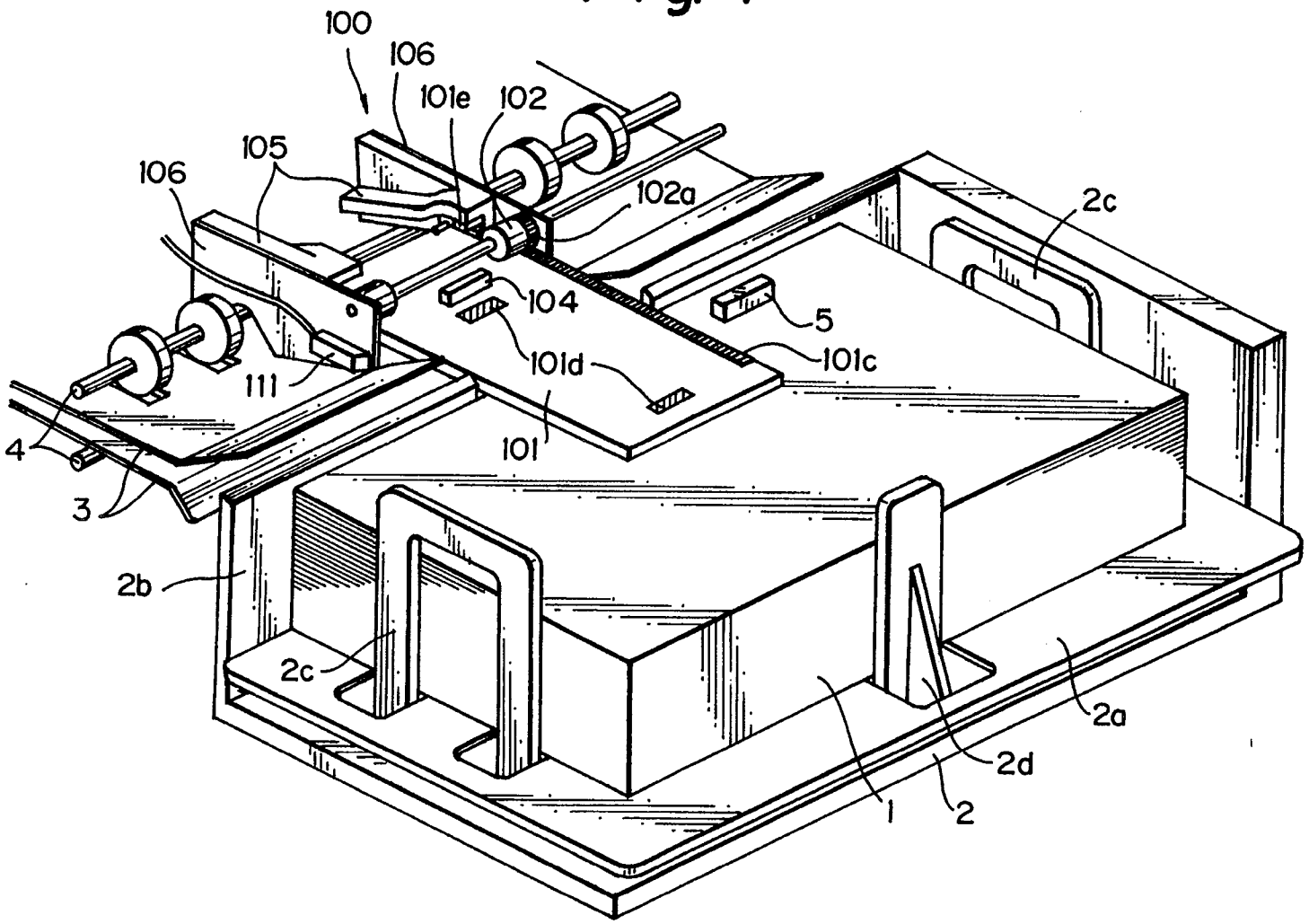
FIG. 1 is a perspective view showing a first embodiment of the sheet feed device in accordance with the present invention.

Preferred embodiments of the sheet feed device for image forming equipment in accordance with the present invention will be described.

1st Embodiment

Referring to FIGS. 1–4F, a sheet feed device embodying the present invention is shown. As shown, the device has a tray 2 including a bottom plate 2*a*. Cut sheets 1 are stacked on the bottom plate 2*a* and surrounded by a front fence 2*b*, side fences 2*c*, and a rear fence 2*d*. The front fence 2*b* is notched in the perpendicular direction over a width greater than the width of a flat plate 101 which will be described. An elevation sensing means 5 is disposed above the downstream side of the sheet stack 1 with respect to an intended direction of sheet feed. It is to be noted that the word "downstream", as well as the word "upstream", to frequently appear in the following description is used in the above-mentioned sense. The sensing means 5 is responsive to the elevation of the sheet stack 1 and implemented by a reflection type photoelectric sensor. Located at the downstream side of the sheet stack 1 is a pick-up unit 100 made up of the flat plate 101, a drive roller 102, a charge roller 103, FIG. 2, a plate sensing means 104 responsive to the flat plate 101 and implemented by a reflection type photosensor, guide members 105, and support plates 106 supporting the guide members 105 as well as other members.

Figure 2:
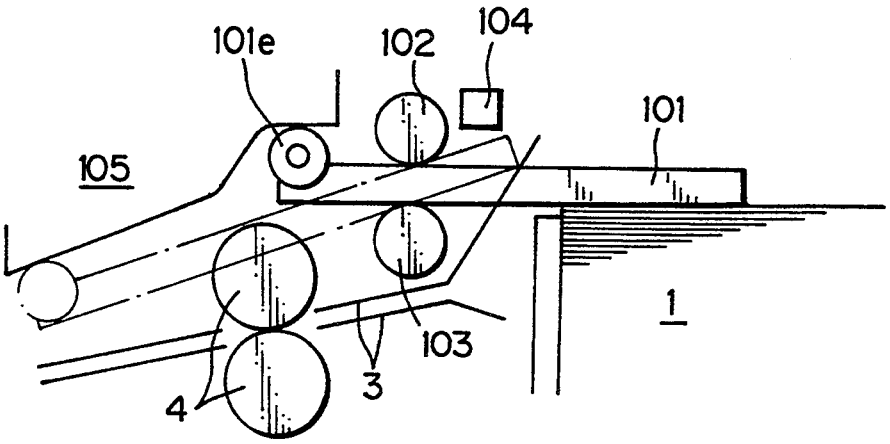
FIG. 2 is a fragmentary sectional side elevation of first embodiment.
Figure 3:
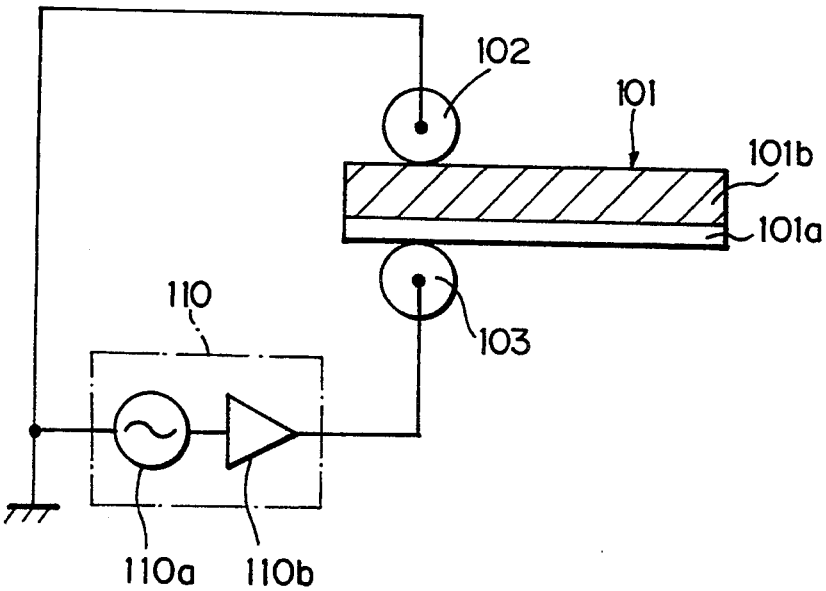
FIG. 3 shows an electric arrangement included in the first embodiment.

As shown in FIG. 3, the flat plate 101 has a dielectric layer 101*a* whose volume resistivity is $10^{12}$ Ωcm, and a conductive layer 101*b* whose volume resistivity is $10^4$ Ωcm or less. The plate 101 is positioned such that the dielectric layer 101*a*, for example, faces the top of the stack 1. As shown in FIG. 1, the drive roller 102 has a gear-toothed portion 102*a* meshing with teeth 101*c* provided on the plate 101. As shown in FIG. 2, the plate 101 is held between the drive roller 102 and the charge roller 103 and is moved in a reciprocating motion above the stack 1 in the sheet feed direction as the drive roller 102 is rotated. The plate 101 has a metallic gloss except for two extremely small non-reflective portions 101*d*. The plate sensing means 104 disposed above the plate 101 determines the position of the plate 101 by sensing either of the non-reflective portions 101*d*. A guide roller 101*e* is provided on the downstream end of the plate 101 and is guided by the drive roller 102 and the guide member 105 located downstream of the drive roller 102.

The drive roller 102 and charge roller 103 both are conductive, and each is constituted by a metallic shaft and conductive rubber wound around the shaft and having a volume resistivity of $10^4$ Ωcm or less. The charge roller 103 extends over substantially the entire width of the flat plate 101 while the drive roller 102 has a small length. As shown in FIG. 3, the drive roller 102 is connected to ground via the support plate 106 and other metallic parts. The charge roller 103 is connected to a power source 110 via a feed section 111, FIG. 1, and insulated from the other constituent parts. Made up of a waveform generator 110*a* and a voltage amplifier 110*b*, the power source 110 applies a sinusoidal wave of ±2 kV to the plate 101 by using the drive roller 102 and charge roller 103 as electrodes.

As shown in FIG. 1, an upper and a lower transport guide 3 are disposed below the pick-up unit 100 and extend obliquely downward from a sheet outlet provided in the unit 100. A pair of transport rollers 4 are positioned at substantially the intermediate positions between opposite ends of the transport guides 3. Particularly, the distance between the front end of the sheet stack 1 in the sheet feed direction and the transport roller pair 4 is selected to be shorter than the length which the plate 101 would overly the stack 1 when protruded most onto the stack 1.

The operation of the embodiment will be described with reference also made to FIGS. 4A–4F. Before a sheet feeding operation begins, the bottom plate 2*a* of the tray 2 loaded with the sheet stack 1 is raised by an elevating mechanism, not shown. When the top of the stack 1 reaches an adequate position as determined by the elevation sensing means 5, the elevating mechanism stops operating. Such a procedure is repeated every time the stack 1 decreases in height due to the sequential sheet feed, so that the top of the stack 1 remains at a constant level.

Figure 4A:
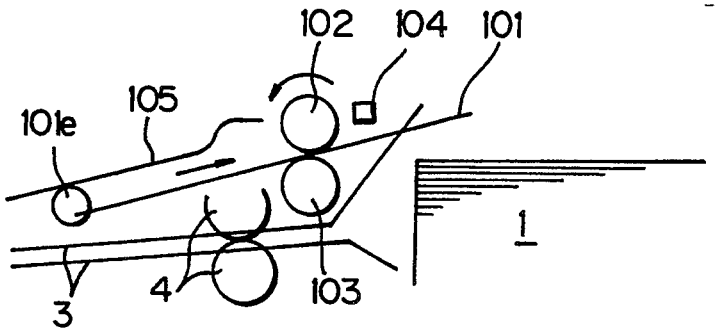
FIGS. 4A–4F are views demonstrating the operation of the first embodiment.

As a control means, not shown, causes the device to start feeding a sheet, the drive roller 102 is rotated in a direction indicated by an arrow in FIG. 4A. Then, the flat plate 101 is moved to above the sheet stack 1 due to the gear portion 102*a* and teeth 101*c* meshing with each other, as shown in FIG. 4A. At the same time, the waveform generator 10*a* of the power source 110 generates a sinusoidal wave of predetermined frequency. As a result, an alternating voltage of ±2 kV is generated via the voltage amplifier 110*b* and is applied to the plate 101 via the drive roller 102 and charge roller 103. This voltage forms an electrostatic pattern alternating in a stripe configuration on the surface of the dielectric layer 101*a* of the plate 101. The pitch of such a stripe pattern is selected to be 5 mm to 20 mm on the surface of the plate 101 on the basis of the feed speed of the plate 101 and the frequency of the alternating voltage of the power source 110.

Figure 4B:
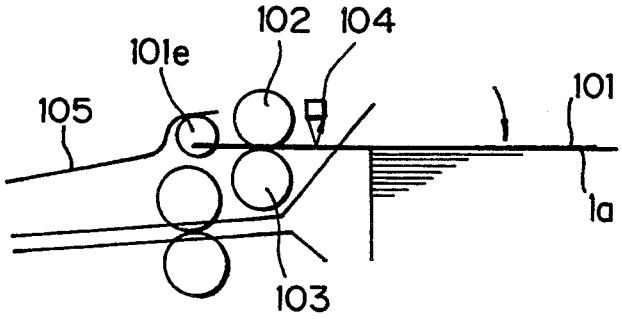

As the plate 101 is sequentially moved by the drive roller 102 as stated above, it rotates about the point thereof held between the drive roller 102 and charge roller 103 with the guide roller 101*e* moving along the guide surface of the guide member 105. Consequently, as shown in FIG. 4B, the plate 101 lies flat on the uppermost sheet 1*a* when protruded most. The plate sensing means 104 determines that the plate 101 has been protruded most by sensing one of the non-reflective portions 101*d* of the plate 101.

Figure 4C:
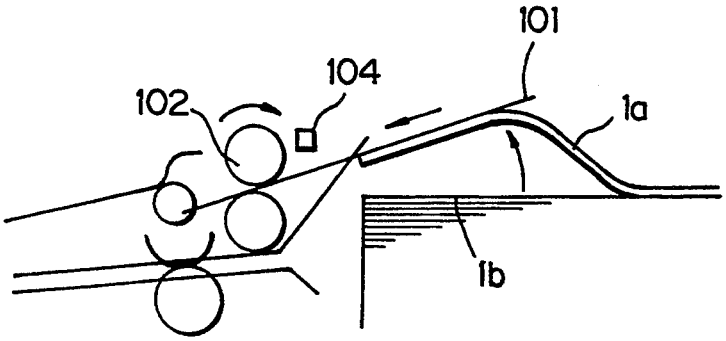

On receiving the resulting output of the plate sensing means 104, the control means reverses the rotation of the drive roller 102 which in turn starts moving the plate 101 in the opposite direction, as shown in FIG. 4C. At this instant, the plate 101 lifts the uppermost sheet 1*a* due to the electrostatic pattern formed thereon. The adhesion due to the electrostatic pattern is so adjusted as not to act on the second sheet 1*b* underlying the uppermost sheet 1*a*, so that the sheet 1*a* may be successfully lifted away from the sheet 1*b*.

Figure 4D:
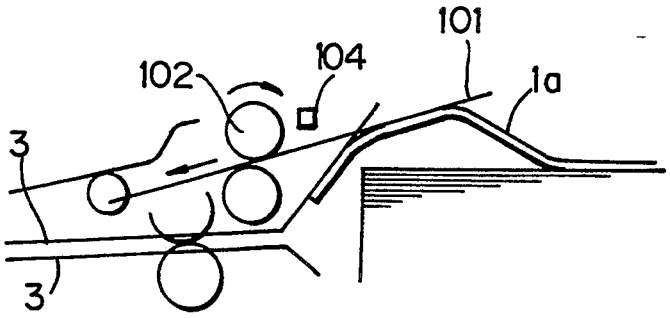
Figure 4E:
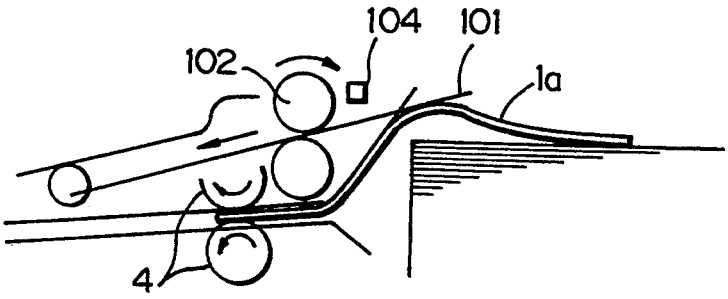

As shown in FIG. 4D, the sheet 1*a* is moved to the left together with the plate 101. However, since the upper transport guide 3 is protruded above the plate 101 which is comparatively narrow, the sheet 1*a* is sequentially separated from the plate 101 from the leading edge to the trailing edge and is guided into the path between the upper and lower transport guides 3.

As shown in FIG. 4D, before the sheet 1*a* is entirely separated from the plate 101 by the upper guide plate 3, the leading edge of the sheet 1*a* is nipped by the transport roller pair 4. As a result, the sheet 1*a* is transported by the roller pair 4 thereafter.

Figure 4F:
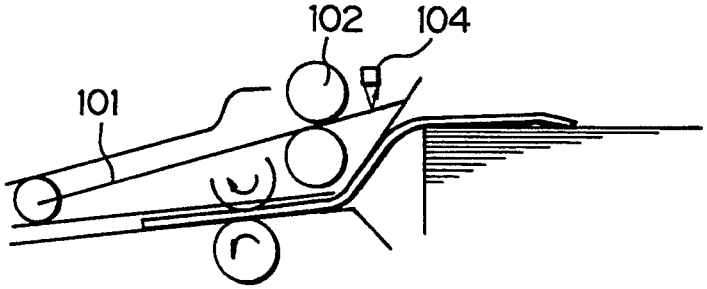

When the fiat plate 101 is pulled back or retracted most, the plate sensing means 104 senses the other non-reflective portion 101*d* of the plate 101. Then, the control means stops driving the drive roller 102, as shown in FIG. 4F.

To feed the sheets 1 continuously, as soon as the trailing edge of the first sheet 1*a* enters the path between the transport guides 3, the drive roller 102 is again rotated to repeat the above-described procedure.

2nd Embodiment.

Figure 5:
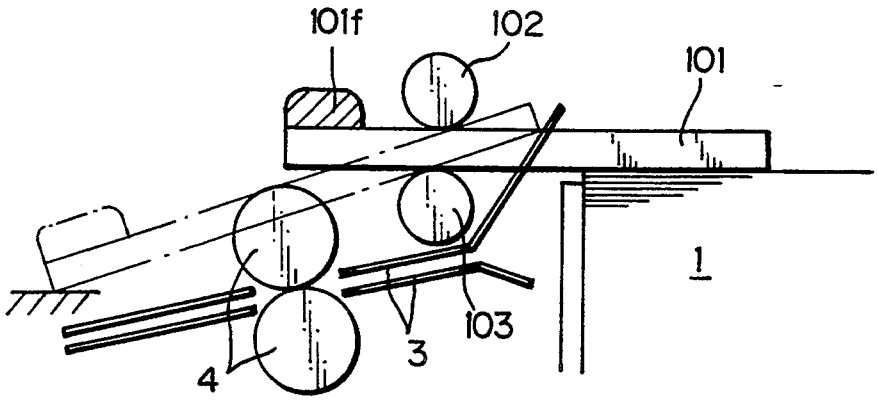
FIG. 5 is a side elevation showing a second embodiment of the present invention.
Figure 6:
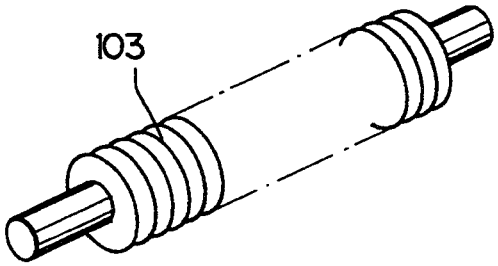
FIG. 6 is a perspective view of a charge roller included in the second embodiment.
Figure 7:
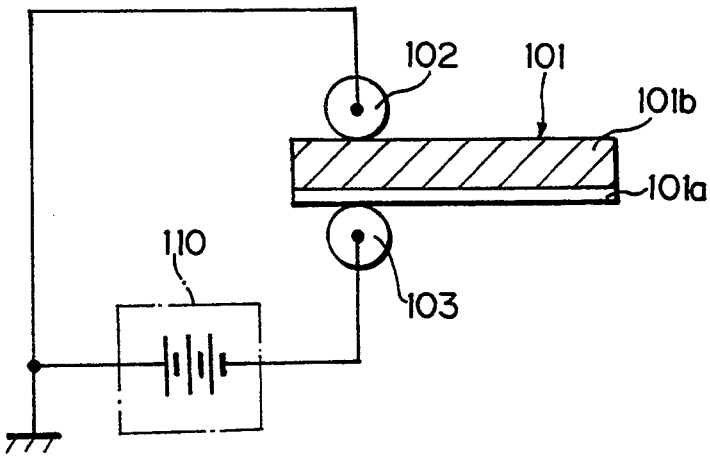
FIG. 7 shows an electric arrangement included in the second embodiment.

Referring to FIGS. 5–7, a second embodiment of the present invention will be described. Since this embodiment is essentially similar to the first embodiment, the same constituent parts will be designated by the same reference numerals, and a detailed description thereof will not be made to avoid redundancy.

As shown in FIG. 6, the charge roller 103 is implemented as an assembly of circular roller elements and also formed by winding conductive rubber having a volume resistivity of $10^4$ Ωcm or less around a metallic shaft. The roller elements may each be about 3 mm wide and spaced apart about 3 mm from nearby elements. FIG. 7 shows the power source 110 which is a DC power source capable of generating a voltage of 4 kV.

As shown in FIG. 5, a balancer 101*f* is mounted on the downstream end of the flat plate 101. The balancer 101*f* is selected such that when the plate 101 protruded above the sheet stack 1 most, the upstream side of the plate 101 falls onto the sheet stack 1.

The operation of this embodiment will be described hereinafter, except for the steps identical with the steps of the first embodiment. As the drive roller 102 driven to move the flat plate 101 to above the sheet stack 1, an electrostatic stripe pattern parallel to the sheet feed direction is formed on the surface of the dielectric layer 101*a* of the plate 101 by the voltage applied via the charge roller 103. The plate 101 usually held in a position where the side thereof where the balancer 101*f* is located is lower than the other side. When the plate 101 is protruded above the stack 1 most, it rotates about the point thereof held between the drive roller 102 and charge roller 103. As a result, the side of the plate 101 remote from the balancer 101*f* falls onto the uppermost sheet 1*a*. Thereafter, as the drive roller 102 is reversed, the plate 101 is returned to the downstream side. As soon as the weight of the side of the plate 101 where the balancer 101*f* is located overcomes the weight of the other side, the plate 101 is moved away from the sheet stack 1 while lifting the uppermost sheet 1*a* therewith. As a result, the sheet 1*a* is separated from the underlying sheet 1*b*.

3rd Embodiment

Figure 8:
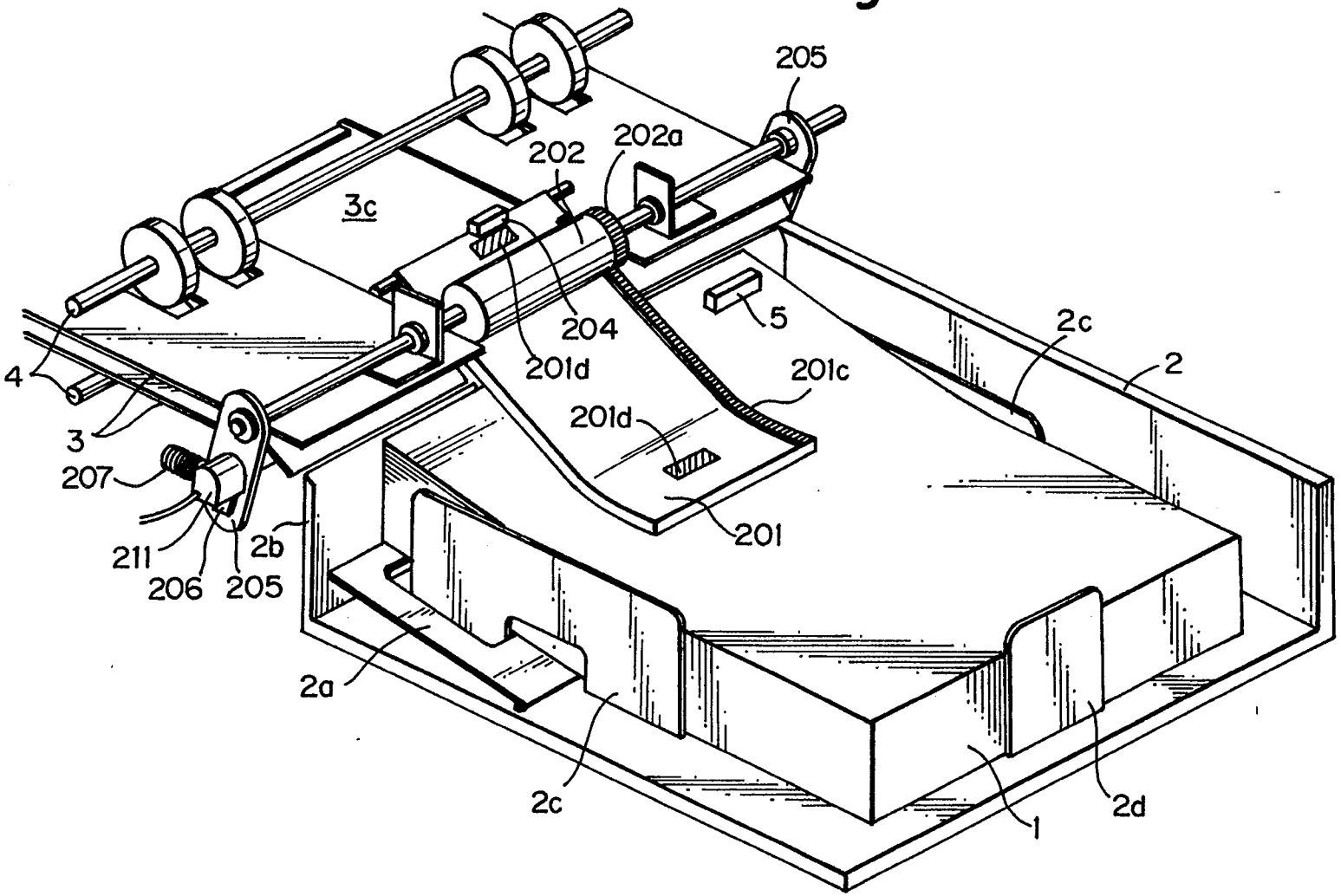
FIG. 8 is a perspective view of a third embodiment of the present invention.

A reference will be made to FIGS. 8–12 for describing a third embodiment of the present invention. As shown in FIG. 8, the device has the tray 2 including the bottom plate 2*a*. The cut sheets 1 are stacked on the bottom plate 2*a* and surrounded by the front fence 2*b*, side fences 2*c*, and rear fence 2*d*. The front fence 2*b* is notched in the perpendicular direction over a width greater than the width of a flat plate 201 which will be described. The downstream side of the bottom plate 2*a* is elevated by an elevating mechanism, not shown, as needed. The elevation sensing means 5 is disposed above the downstream side of the stack 1. The sensing means 5 is responsive to the elevation of the sheet stack 1 and implemented by a reflection type photoelectric sensor. The upper and lower transport guides 3 are located downstream of the stack 1. Also located downstream of the stack 1 are the flat plate 201, a drive roller 202, a charge roller 203, FIG. 9, a plate sensing means 204 implemented by a reflection type photosensor, support brackets 205, and biasing means 206 and 207.

Figure 9:
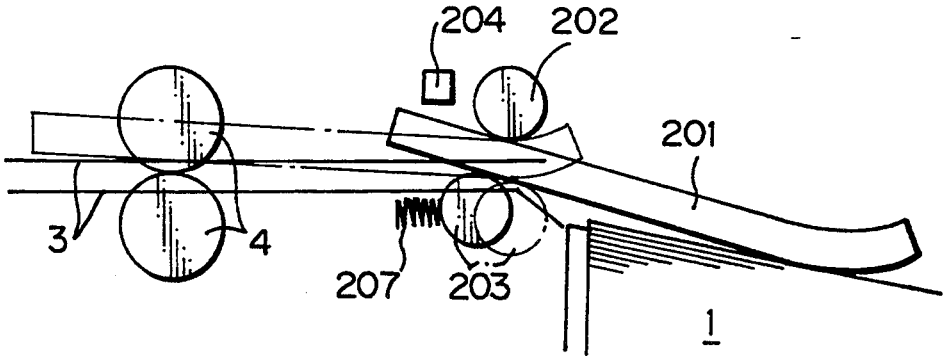
FIG. 9 is a fragmentary side elevation of the third embodiment.
Figure 10:
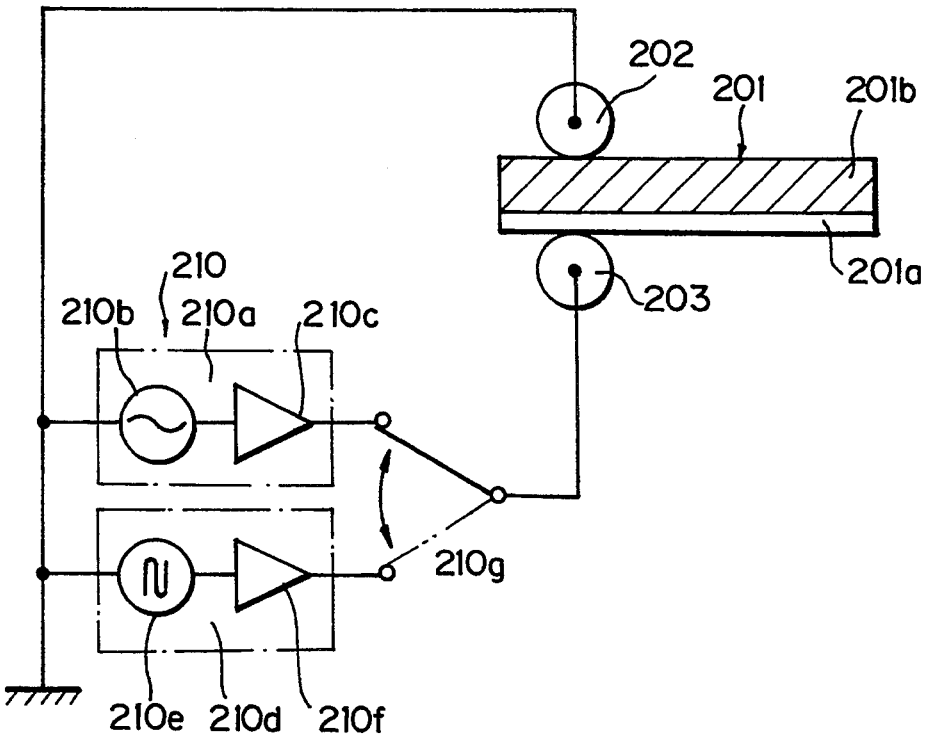
FIG. 10 shows an electric arrangement included in the third embodiment.

As shown in FIG. 10, the flat plate 201 is made up of a dielectric layer 201*a* whose volume resistivity is $10^{12}$ Ωcm, and a conductive layer 201*b* whose volume resistivity is $10^4$ Ωcm or less. The dielectric layer 201*a*, for example, faces the top of the sheet stack 1. As shown in FIG. 8, the plate 201 is in the form of a rectangle having a smaller width than the stack 1 and extending in the sheet reed direction. Further, the plate 201 includes a curved portion where the surface of the dielectric layer 201*a* is convex. As shown in FIG. 8, the drive roller 202 has a gear-toothed portion 202*a* meshing with teeth 201*c* provided on the flat plate 201. As shown in FIG. 9, the flat plate 201 is held between the drive roller 202 and the charge roller 203 and is moved in a reciprocating motion above the sheet stack 1 in the sheet feed direction as the drive roller 202 is rotated. The plate 201 has a metallic gloss except for two extremely small non-reflective portions 201*d*. The plate sensing means 204 disposed above the plate 201 determines the position of the plate 201 by sensing either of the non-reflective portions 201*d*.

Figure 12:
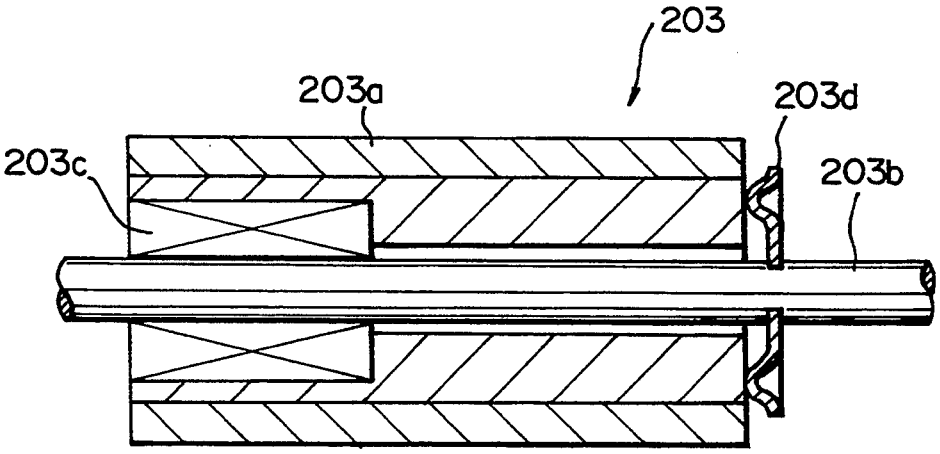
FIG. 12 is a section of a charge roller included in the third embodiment.

The brackets 205 of the charge roller 203 are rotatable coaxially with the shaft of the drive roller 202. The biasing means 206 constantly biases the charge roller 203 toward the drive roller 202. The other biasing means 207 constantly biases the brackets 205 to the upstream side. As shown in FIG. 12, the charge roller 203 is made up of a roller portion 203*a*, a shaft 203*b*, and a torque limiter 203*c* intervening between the roller portion 203*a* and the shaft 203*b*. The torque limiter 203*c* generates a torque when the roller portion 203*a* is rotated at least in the direction for moving the fiat plate 201 to the downstream side, and it is reversible. The drive roller 202 and charge roller 203 both are conductive, and each is constituted by winding conductive rubber having a volume resistivity of $10^4$ Ωcm or less around a metallic shaft. The drive roller 202 is connected to ground via the transport guides 3 and other metallic parts. The charge roller 203 extends over substantially the entire width of the plate 201. The roller portion 203*a*, FIG. 12, is connected to the power source 210, FIG. 10, via a leaf spring 203*d*, the shaft 203*b*, and a feed section 211 and insulated from the other constituent parts.

As shown in FIG. 10, the power source 210 has a charge voltage generating section 210*a* made up of a waveform generator 210*b* and a voltage amplifier 210*c*, a discharge voltage generating section 210*d* made up of a waveform generator 210*e* and a voltage amplifier 210*f*, and a switching means 210*g* for selecting either of the voltage generating sections 210*a* and 210*d*. The power source 210 applies an alternating voltage to the plate 210 by using the drive roller 202 and charge roller 203 as electrodes. An arrangement may be so made as to discharge only a part of a charging area by any conventional scheme.

The upper transport guide 3 adjoining the drive roller 202 has a removed portion or notch 3*c* in a part thereof which would otherwise interfere with the plate 201 if the plate 201 were returned to the downstream side. The distance between the front end of the stack 1 and the transport roller pair 4 is selected to be shorter than the length which the plate 101 would overly the stack 1 when protruded onto the stack 1 most.

A reference will also be made to FIGS. 11A–11E for describing the operation of the third embodiment. Before a sheet feeding operation begins, the bottom plate 2*a* of the tray 2 loaded with the stack 1 has the downstream side thereof angularly raised by an elevating mechanism, not shown. When the top of the stack 1 reaches an adequate position as determined by the elevation sensing means 5, FIG. 8, the elevating mechanism stops operating. Such a procedure is repeated every time the sheet stack 1 decreases in height due to the successive sheet feed, so that the top of the stack 1 remains at a constant level.

Figure 11A:
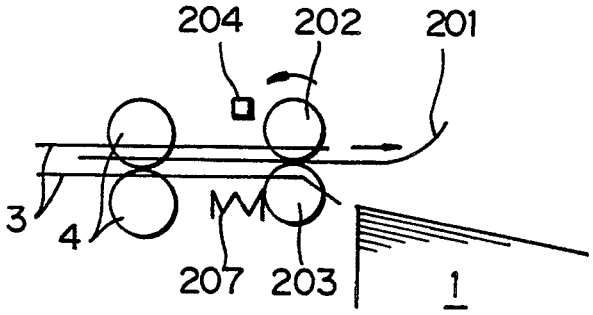
FIGS. 11A–11E are views representative of the operation of the third embodiment.

As a control means, not shown, causes the device to start feeding a sheet, the drive roller 202 is rotated in a direction indicated by an arrow in FIG. 11A. Then, the flat plate 201 is moved to above the stack 1 due to the gear portion 202*a* and teeth 201*c* meshing with each other, as shown in FIG. 11A. At the same time, the waveform generator 210*a* of the power source 210 generates a sinusoidal wave of predetermined frequency. As a result, an alternating voltage of ±2 kV is generated via the voltage amplifier 210*b*. At this time, the switching means 210*g* has connected the charge voltage generating section 210*a* to the charge roller 203. Hence, the alternating voltage is applied to the plate 201 via the drive roller 202 and charge roller 203. This voltage forms an electrostatic pattern alternating in a stripe configuration on the surface of the dielectric layer 201*a* of the plate 201. The pitch of such a stripe pattern is selected to be 5 mm to 20 mm on the surface of the plate 201 on the basis of the feed speed of the plate 201 and the frequency of the alternating voltage of the power source 210. Further, the charge roller 203 is sequentially moved toward the upstream side about the shaft of the drive roller 202 together with the brackets 205 due to the pulling force of the plate 201 and the bias of the biasing means 207.

Figure 11B:
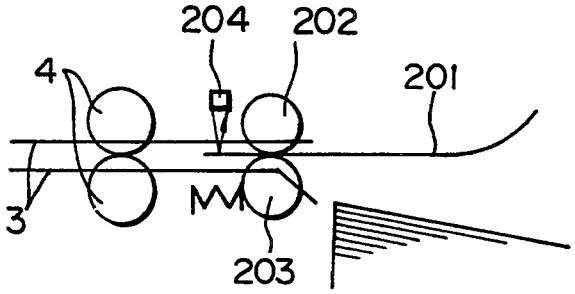
Figure 11C:
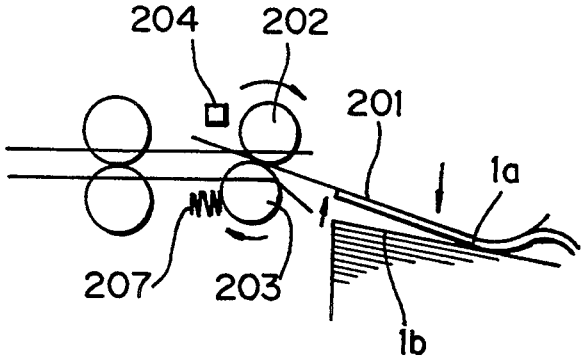

As shown in FIG. 11B, when the plate 201 is moved to above the stack 1 most, the plate sensing means 204 senses one of the non-reflective portion 201*d* of the plate 201. On receiving the resulting output of the sensing means 204, a control means, not shown, reverses the drive roller 202 to thereby move the plate 201 in the opposite direction. The plate 201 in turn urges the charge roller 203 to the downstream side. At this instant, since the force of the biasing means 207 is selected to be smaller than the force of the plate 201 acting on the charge roller 203, the charge roller 203 is moved to the downstream side about the shaft of the drive roller 202 together with the brackets 205. As a result, the plate 201 held between the rollers 202 and 203 is further rotated about the shaft of the roller 202 until it abuts against the uppermost sheet 1*a*.

The uppermost sheet 1*a* is electrostatically adhered to the plate 201 due to the electrostatic pattern formed on the plate 201. At this instant, despite that the angle at which the plate 201 contacts the uppermost sheet 1*a* depends on the amount of the stack 1, the plate 201 can surely cause the uppermost sheet 1*a* to adhere thereto due to the previously mentioned convex portion. Further, as shown in FIG. 11 C, since the uppermost sheet 1*a* adheres to the plate 201 in a curved configuration, it is positively separated from the underlying sheet 1*b*. The control means reverses the drive roller 202 and, at the same time, causes the switching means 210*g* of the power source 210 to select the discharge voltage generating section 210*d*. The waveform generator 210*e* and voltage amplifier 210*f* of the voltage generating section 210*d* generate an alternating voltage of about ±800 V and having a frequency which is one-tenth or less of the output voltage of the other voltage generating section 210*a*. Consequently, an alternating voltage is applied to the surface of the plate 201 for erasing the electrostatic pattern ascribable to the previous charging.

The sheet 1*a* electrostatically adhered to the plate 201 is moved to the left, as viewed in the figures, by being nipped by the drive roller 202 and charge roller 203 together with the plate 201. The part of the sheet 1*a* moved away from the rollers 202 and 203 is separated from the plate 201 by the discharge voltage applied thereto from the charge roller 203.

When the sheet 1*a* is adhered to the plate 201, it may occur that the underlying sheet 1*b* is moved toward the nipping portion of the rollers 202 and 203 due to the irregularity in the cut edges of the sheets, friction between the sheets, etc. In the illustrative embodiment, when only the plate 201 or only the plate 201 and sheet 1*a* are moved to the downstream side via the nipping portion, the friction between the plate 201 or sheet 1*a* and the charge roller 203 overcomes the torque of the torque limiter 203*c*. As a result, the charge roller 203 is rotated by the plate 201 which is in movement. However, when the second sheet 1*b* is moved to the nipping portion together with the sheets 1*a*, the torque of the torque limiter 203*c* overcomes the friction between the sheets 1*a* and 1*b* and prevents the sheet 1*b* from reaching the nipping portion.

Figure 11D:
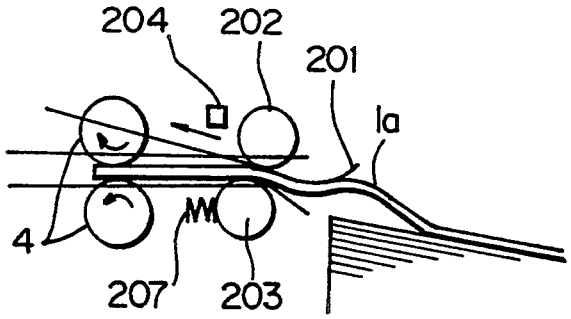
Figure 11E:
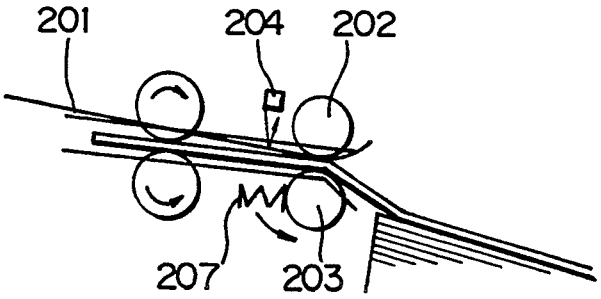

As shown in FIG. 11D, before the sheet 1*a* is entirely separated from the plate 201, the leading edge thereof arrives at the nipping portion of the transport roller pair 4. Thereafter, the sheet 1*a* is transported by the roller pair 4. When the plate 201 is returned or pulled back most, the plate sensing means 204 senses the other non-reflective portion 201*d* with the result that the control means stops driving the drive roller 202 and power source 210. The charge roller 203 is returned to the upstream side by the biasing means 207 together with the brackets 205, as shown in FIG. 11E.

When the sheet 1*b* should be fed just after the sheet 1*a*, the drive roller 202 is gain driven just after the trailing edge of the sheet 1*a* has moved away from the nipping portion of the drive roller 202 and charge roller 203. This is followed by the procedure described above.

While the shaft 203*b* of the charge roller 203 has been shown and described as being fixed in place, it may be driven in a direction for returning the sheet 1 to the upstream side. Then, even when two or more sheets arrive at the nipping portion of the drive roller 202 and charge roller 203, only the uppermost sheet 1*a* will be more surely separated from the others.

4th Embodiment

Figure 13:
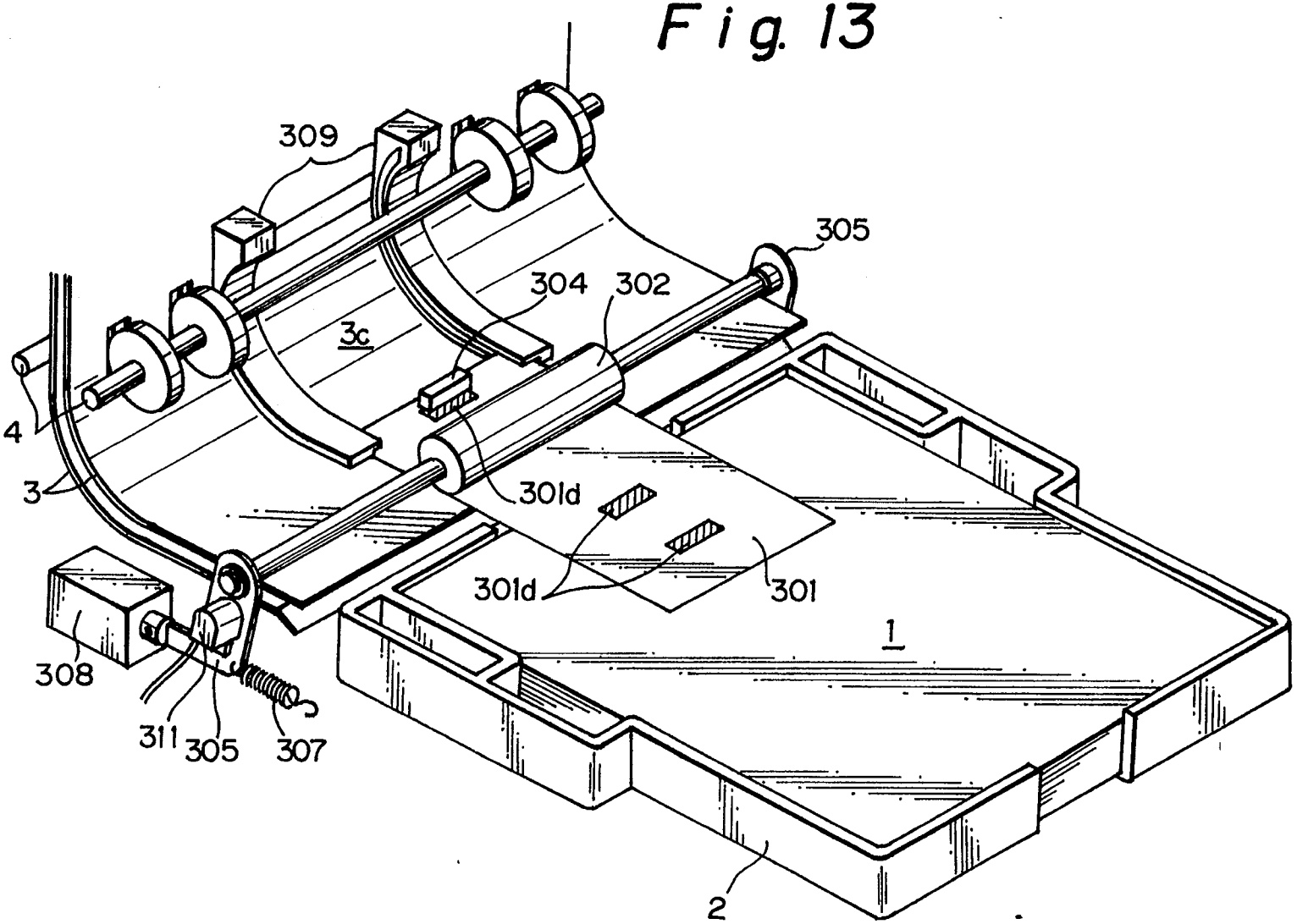
FIG. 13 is a perspective view of a fourth embodiment of the present invention.

Referring to FIGS. 13–16E, a fourth embodiment of the present invention will be described. As shown in FIG. 13, the cut sheets 1 are also stacked on the tray 2 capable of accommodating about 200 sheets at a maximum. The tray 2 includes a front fence which is formed with a perpendicular notch greater in width than a flat plate 301 which will be described. An upper and a lower transport guide 3 are disposed downstream of the sheet stack 1. Also disposed downstream of the stack 1 are a plate sensing means 304 implemented by a reflection type photosensor, brackets 305, a biasing means 307, a solenoid 308, and guide grooves 309.

Figure 14:
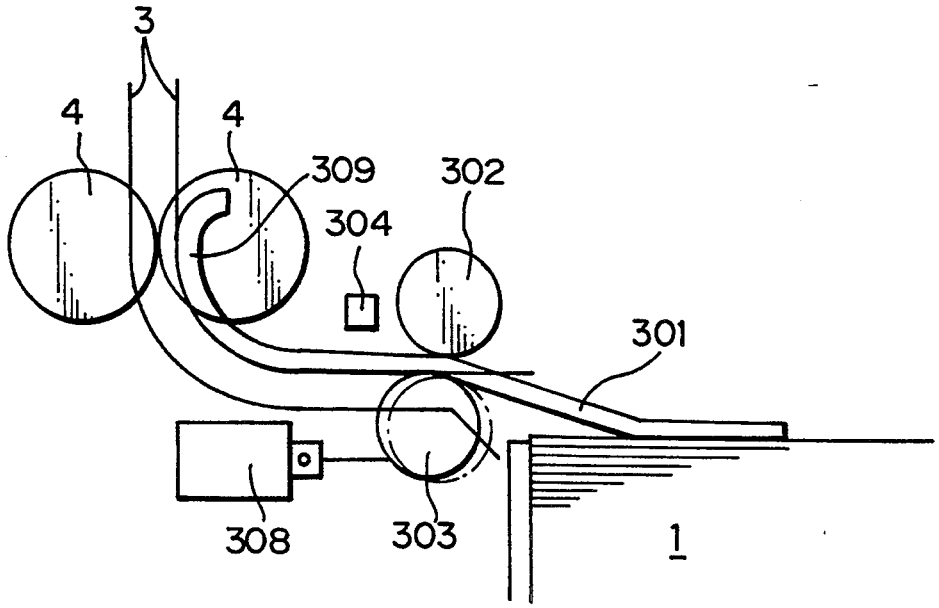
FIG. 14 is a fragmentary sectional side elevation of the fourth embodiment.
Figure 15:
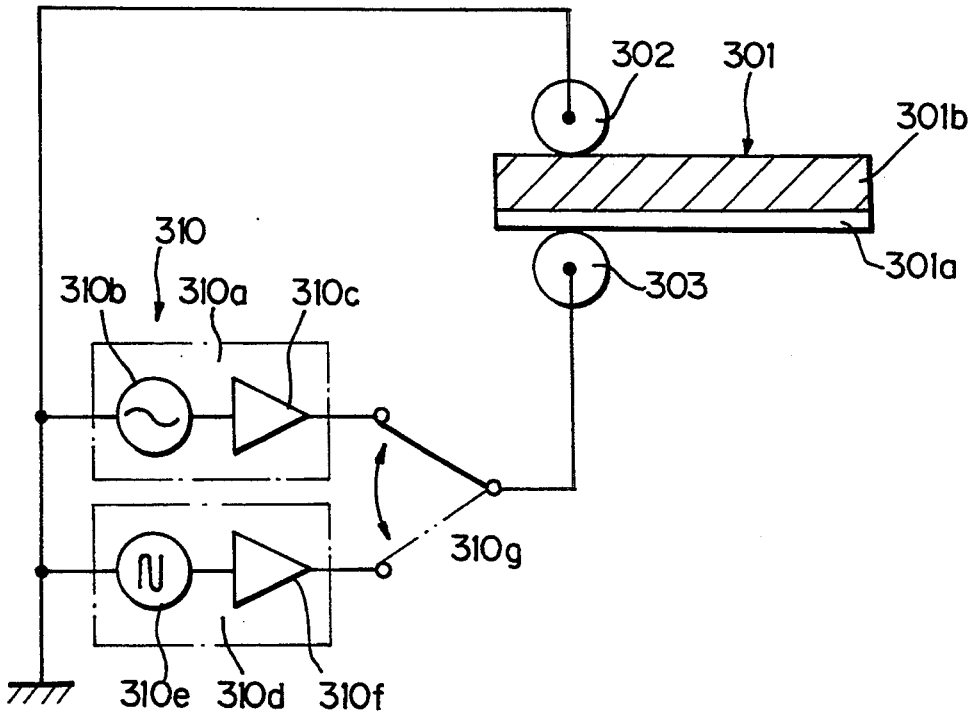
FIG. 15 shows an electric arrangement included in the fourth embodiment.

The flat plate 301 is flexible and constituted by about 1 mm thick PET. As shown in FIG. 15, the plate 301 is made up of a dielectric layer 301*a* whose volume resistivity is $10^{12}$ Ωcm, and a conductive layer 301*b* whose volume resistivity is $10^4$ Ωcm or less. The dielectric layer 301*a*, for example, faces the top of the stack 1. The plate 301 is in the form of a rectangle having a smaller width than the sheet stack 1 and extending in the sheet feed direction. As shown in FIG. 14, the plate 301 is held between a drive roller 302 and a charge roller 303 and is moved in a reciprocating motion above the stack 1 in the sheet feed direction as the drive roller 302 is rotated. The plate 301 has a metallic gloss except for two extremely small non-reflective portions 301*d*. The plate sensing means 304 disposed above the plate 301 determines the position of the plate 301 by sensing either of the non-reflective portions 301*d*.

The brackets 305 of the charge roller 303 are rotatable coaxially with the shaft of the drive roller 302. The biasing means 307 constantly biases the charge roller 303 toward the drive roller 302. The brackets 305 are rotated by the solenoid 308. The drive roller 302 and charge roller 303 both are conductive, and each is constituted by winding conductive rubber having a volume resistivity of $10^4$ Ωcm or less around a metallic shaft.

The drive roller 302 is connected to ground via the transport guides 3 and other metallic parts, as shown in FIG. 15. The charge roller 303 is connected to a power source 310, FIG. 13, via a feed section 311 and is insulated from the other constituent parts.

As shown in FIG. 15, the power source 310 has a charge voltage generating section 310*a* made up of a waveform generator 310*b* and a voltage amplifier 310*c*, a discharge voltage generating section 310*d* made up of a waveform generator 310*e* and a voltage amplifier 310*f*, and a switching means 310*g* for selecting either of the voltage generating sections 310*a* and 310*d*. The power source 310 applies an alternating voltage to the plate 301 by using the drive roller 302 and charge roller 303 as electrodes. An arrangement may be so made as to discharge only a part of a charging area by any conventional scheme.

The transport guides 3 are each made up of a horizontal portion adjoining the drive roller 302 and charge roller 303, and a perpendicular portion extending from the downstream end of the horizontal portion. The upper transport guide 3 adjoining the drive roller 302 has a notch 3*c* for accommodating the plate 301 when the plate 301 is pulled back most. The guide grooves 309 are formed in the intermediate portion of the upper transport guide 3 at both sides of the notch 3*c* so as to guide the edges of the plate 301. In the perpendicular portion of the upper transport guide 3, the guide grooves 309 are shaped such that the downstream end of the plate 301 moves away from the guide 3, as shown in FIG. 13. The transport roller pair 4 is located just downstream of the curved portion of the transport guides 309 where the horizontal portion merges into the perpendicular portion, and at both sides of the guide grooves 309. Particularly, the nipping portion of the transport roller pair 4 is located substantially at the same position as the position where the guide grooves 309 are directed away from the guide plate 3.

The operation of this embodiment will be described with reference to FIGS. 16A–16E. As a control means, not shown, causes the sheet feed device to start operating, the drive roller 302 is rotated in a direction indicated by an arrow in FIG. 16A. Then, the flat plate 301 held between the drive roller 302 and charge roller 303 is driven to above the sheet stack 1. At the same time, in the power source section 310, the waveform generator 310*b* generates a sinusoidal wave of predetermined frequency. The charge voltage generating section 310*a*, therefore, generates an alternating voltage of ±2 kV via the voltage amplifier 310*c*. At this instant, the switching means 310*g* has connected the charge voltage generating section 310*g* to the charge roller 303. The alternating voltage is applied to the plate 301 via the drive roller 302 and charge roller 303. As a result, an electrostatic pattern alternating in a stripe configuration is formed on the surface of the dielectric layer 301*a* of the plate 301. The pitch of the stripe pattern is selected to be 5 mm to 20 mm on the surface of the plate 301 on the basis of the feed speed of the plate 301 and the frequency of the alternating voltage. The biasing means 307 causes the charge roller 202 to move to the upstream side about the shaft of the drive roller 302 together with the brackets 305.

Figure 16A:
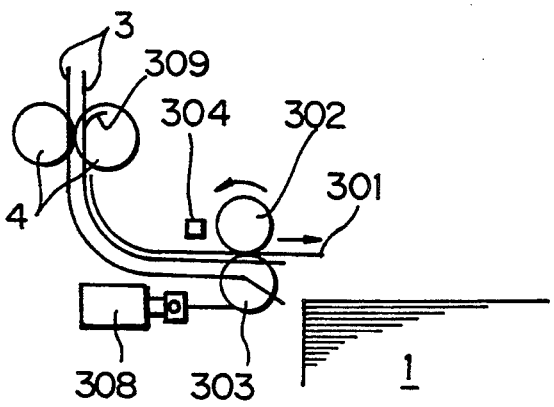
FIGS. 16A–16E are views demonstrating the operation of the fourth embodiment.
Figure 16B:
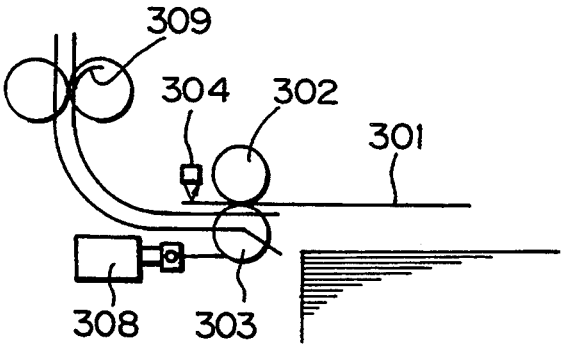
Figure 16C:
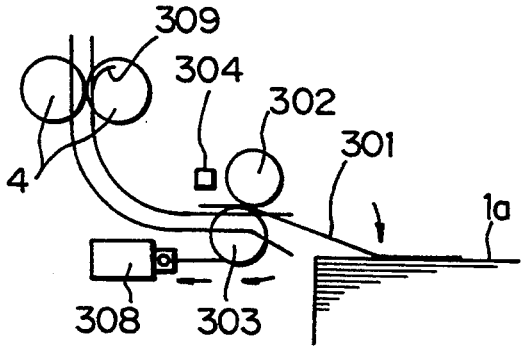
Figure 16D:
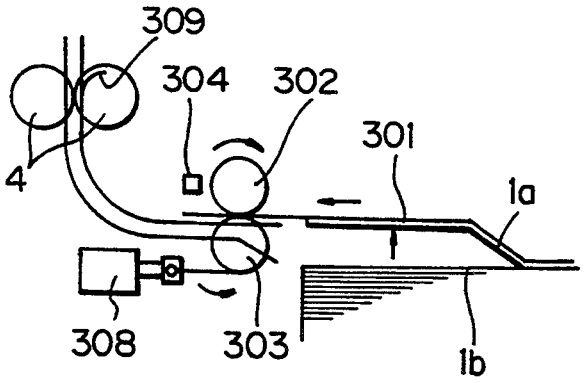

As shown in FIG. 16B, when the plate 301 is fed out most, the plate sensing means 304 senses one of the non-reflective portions 301*d* of the plate 301. In response to the resulting output of the sensing means 304, the control means energizes the solenoid 308 for an extremely short period of time. Since the force of the biasing means 307 is selected to be smaller than the pulling force of the solenoid 308, the charge roller 303 is moved to the downstream side about the shaft of the drive roller 302 together with the brackets 305. As a result, the plate 301 held between the drive roller 302 and charge roller 303 is bent in the vicinity of the nipping portion of the rollers 302 and 303, as shown in FIG. 16C. Consequently, the plate 301 abuts against the uppermost sheet 1*a* of the stack 1. It is noteworthy that the plate 301 is flexible and, therefore, surely contacts the sheet 1*a* with no regard to the amount of the stack 1. The sheet 1*a* electrostatically adheres to the plate 301 due to the electrostatic pattern formed on the plate 301. Subsequently, as the control means deenergizes the solenoid 308, the sheet 1*a* is lifted together with the plate 301. Since the force of the electrostatic pattern is so adjusted as not to act on the sheet 1*b* underlying the sheet 1*a*, the sheet 1*a* is surely separated from the sheet 1*b*, as shown in FIG. 16D.

After the above procedure, the control means reverses the drive roller 302. Then, the plate 301 is moved to the left, as viewed in the figures, along the guide grooves 309 while carrying the sheet 1*a* therewith. When the leading edge of the sheet 1*a* moves, for example, about 30 mm away from the nipping portion of the drive roller 302 and charge roller 303, the plate sensing means 304 senses the other non-reflective portion 301*d*. On receiving the resulting output of the sensing means 304, the control means causes the switching means 310 of the power source to select the discharge voltage generating means generating means. The waveform generator 310*e* and voltage amplifier 310*f* generate an alternating voltage of about ±800 V and having a frequency which is one-tenth or less of the voltage of the charge voltage generating section 310*a*. As a result, an alternating voltage which erases the electrostatic pattern is applied to the surface of the plate 301. The sheet 1*a* passed the nipping portion of the drive roller 302 and charge roller 303 is separated, except for the leading edge portion thereof, from the plate 301 by the alternating voltage applied from the charge roller 303.

Figure 16E:
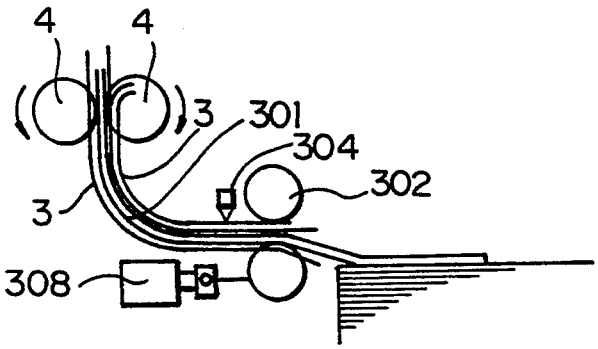

The sheet 1*a* is transported along the path between the transport guides 3 with the leading edge portion thereof continuously retained by the plate 301. The plate 301 is moved away from the guide plates 3 by having the leading edge thereof bent along the guide grooves 309. The leading edge portion of the sheet 1*a* arrived at the transport roller pair 4 is separated from the plate 301 due to the curvature of the plate 301. Thereafter, the sheet 1*a* is driven by the transport roller pair 4. This prevents the sheet 1*a* from jamming the path at the bent portion of the transport guides 3 and, in addition, eliminates the need for rollers exerting a great nipping force otherwise located at the bent portion. As shown in FIG. 16E, as soon as the plate sensing means 304 senses the other non-reflective portion 301*d*, the control means stops driving the drive roller and plate 301.

To feed the sheet 1*b* after the sheet 1*a*, the control means again starts driving the drive roller 302 just after the trailing edge of the sheet 1*a* has passed the nipping portion of the rollers 302 and 303. This is followed by the procedure described above.

While the embodiments have concentrated on a flat plate having a flat surface and movable along a linear path, they are similarly practicable with a bent plate movable in a rotary motion.

In summary, it will be seen that the present invention provides a sheet feed device which feeds a sheet by the simple reciprocating motion of a flat plate and electrostatic adhesion. The electrostatic adhesion effects more stable sheet feed against aging and environmental changes than friction. By adjusting the electrostatic adhesion, it is possible to reduce the probability of the simultaneous feed of two or more sheets. Since the flat plate is retracted except during sheet feed operation by the reciprocating motion thereof, the operator can supplement sheets with ease under safe conditions. In addition, the operator is prevented from inadvertently touching the flat plate; otherwise, the sheet feeding ability would be degraded.

Various modifications will become possible for those skilled in the art after receiving the teachings of the present disclosure without departing from the scope thereof.

What is claimed is:

1. A sheet feed device for image forming equipment and capable of feeding sheets one by one from a stack by separating said sheets, said device comprising:
- a plate having a dielectric portion capable of making surface-to-surface contact with a top of the stack, wherein said plate comprises a flat plate having a flat surface;
- a reciprocating means for causing said plate to move in a reciprocating motion, wherein said reciprocating means comprises:
  - a pair or rollers nipping said flat plate and at least one of which is a drive roller; and
  - teeth holding said drive roller and said flat plate in mesh with each other;
- a moving means for selectively moving said plate into or out of contact with the top of the stack; and
- a voltage applying means for applying a voltage to said plate to cause said plate to exert an electrostatic adhering force.

2. A sheet feed device for image forming equipment and capable of feeding sheets one by one from a stack by separating said sheets, said device comprising:
- a plate having a dielectric portion capable of making surface-to-surface contact with a top of the stack;
- a reciprocating means for causing said plate to move in a reciprocating motion, wherein said reciprocating means comprises a pair of rollers nipping said flat plate and at least one of which is a drive roller and teeth holding said drive roller and said flat plate in mesh with each other;
- a moving means for selectively moving said plate into or out of contact with the top of the stack; and
- a voltage applying means for applying a voltage to said plate to cause said plate to exert an electrostatic adhering force.

3. A device as claimed in claim 2, wherein said plate comprises a flat plate having a flat surface.

4. A device as claimed in claim 3, further comprising at least one sensing means for sensing a position of said flat plate.

5. A device as claimed in claim 3, wherein a surface of said plate plate facing the stack has a convex portion.

6. A device as claimed in claim 3, wherein said voltage applying means charges said flat plate when said flat plate is in a forward movement or discharges said flat plate when said flat plate is in a return movement.

7. A device as claimed in claim 3, wherein said flat plate comprises a flexible member.

8. A device as claimed in claim 3, wherein said flat plate comprises a flexible member and is guided by a bent transport path located at a downstream side with respect to an intended direction of sheet feed.

9. A device as claimed in claim 3, wherein said voltage applying means charges said flat plate when said flat plate is in a forward movement or discharges a part of said flat plate when said flat plate is in a return movement.

* * * * *